US006715422B2

(12) United States Patent
Nishida

(10) Patent No.: US 6,715,422 B2
(45) Date of Patent: Apr. 6, 2004

(54) PLATE PRODUCING APPARATUS HAVING CONTROLLER FOR CONTROLLING CASSETTE SELECTION ASSEMBLY

(75) Inventor: Masahiro Nishida, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 21 days.

(21) Appl. No.: 10/155,121

(22) Filed: May 28, 2002

(65) Prior Publication Data

US 2002/0175963 A1 Nov. 28, 2002

(30) Foreign Application Priority Data

May 28, 2001 (JP) ..... 2001-159133

(51) Int. Cl.[7] ..... B41F 27/12
(52) U.S. Cl. ..... 101/477; 101/401.1; 347/262
(58) Field of Search ..... 101/477, 401.1, 101/484, 463.1, 467; 271/9.01, 9.05; 347/262, 264, 2, 104

(56) References Cited

U.S. PATENT DOCUMENTS 5,738,014 A 4/1998 Rombult et al. ..... 101/477
5,992,324 A * 11/1999 Rombult et al. ..... 101/477
6,084,602 A 7/2000 Rombult et al. ..... 347/262

FOREIGN PATENT DOCUMENTS

EP 106109 A2 12/2000
JP 2000-351460 12/2000

* cited by examiner

*Primary Examiner*—Leslie J. Evanisko
(74) *Attorney, Agent, or Firm*—McDermott, Will & Emery

(57) ABSTRACT

In a plate producing apparatus which consecutively produces a set of four plates, a wait time is conventionally observed to await the feeding of a plate in an image recording section in the case where the set of plates is switched. In order to solve this problem, a multi-cassette section 14 horizontally moves a selected one of a plurality of cassettes 31 to an autoloading section 15. The autoloading section 15 moves the cassette 31 after undergoing the horizontal movement to a plate feeding position through up-and-down movements, retrieves a plate P from that cassette 31, and feeds the plate P to an image recording section 16. The image recording section 16 winds the plate thus fed around a recording drum 36, records an image thereon by means of a recording head 37, and releases the recorded plate from the recording drum 36 so as to be ejected. While the image recording section 16 is recording an image on the plate, a CPU 11 receives control information C associated with a next plate, and causes the multi-cassette section 14 and the autoloading section 15 to sequentially operate by using the control information C.

4 Claims, 10 Drawing Sheets

PLATE PRODUCING APPARATUS HAVING CONTROLLER FOR CONTROLLING CASSETTE SELECTION ASSEMBLY

BACKGROUND OF THE INVENTION

1. Field of the Invention

The present invention relates to a plate producing apparatus. More particularly, the present invention relates to a plate producing apparatus capable of recording images on plates which are accommodated in a plurality of cassettes, the images being received from an image processing device.

2. Related Art Statement

Printing of color printed materials is achieved by transferring images of a plurality of colors onto a single piece of printing paper. The transfer of the respective color images is realized by using plates. Plates of Y (Yellow), M (Magenta), C (Cyan), and K (Kuro, i.e., "black") are commonly employed for color printing. In addition or in the alternative to these color plates, plates of special colors may be used. For example, printing may be performed by adding special colors to the four basic colors of Y, M, C, and K, or using the special colors alone. In the following description, a plurality of plates which are used in superposition to make one printed material are referred to as a "set of plates". (Note, however, that the present invention is also applicable to single-color printing. In that case, a "set of plates" should be interpreted to mean a single plate).

In order to produce plates, an image recording apparatus of a so-called CTP (Computer To Plate) type, which records images directly on plates such as PS plates (Presensitized Plates) may be employed. This type of image recording apparatus irradiates each plate with a light beam which has been modulated in accordance with the image data for that plate, whereby desired images are recorded on the respective plates.

In order to realize automatic feeding of plates to an image recording apparatus, cassettes for accommodating plates and a mechanism for feeding the plates from the cassette to the image recording apparatus are required. Japanese Patent Laid-Open Publication No. 2000-351460 discloses an example of a plate feeding apparatus which feeds plates to an image recording apparatus. The disclosed plate feeding apparatus moves one of a plurality of cassettes along a horizontal direction, and further brings up or down the cassette thus moved, to a position for feeding plates to an image recording apparatus. Thereafter, the plate feeding apparatus feeds the plates from the cassette which is in the predetermined position to the image recording apparatus, and ejects the slip sheets which are inserted between the plates.

On the other hand, image data representing images to be recorded on the plates is supplied from a raster image processor (hereinafter referred to as a "RIP"), which operates independently from the image recording apparatus. Also supplied from the RIP is the information which is used when selecting a cassette (referred to as "control information", e.g., information representing the size and thickness of a given plate). A set of plates usually comprises the same type of plates, and hence the plates are usually fed from a single cassette. Conventionally, control information associated with a given set of plates is transmitted from the RIP to the image recording apparatus as common control information to all plates, even before the transmission of the image data (see FIG. 7).

However, a conventional image recording apparatus has the following problem. The apparatus begins the preparation for a set of plates only after the image recording for a previous set of plates is completed. Therefore, if the latter set of plates is of a different type from the previous set of plates, an exchange of cassettes must be performed, which can only be performed after the image recording for the previous set of plates is completed. As a result, a wait time must be observed before the feeding of the latter set of plates can be begun. As such, the image recording apparatus cannot be utilized to its full capacity.

SUMMARY OF THE INVENTION

Therefore, an object of the present invention is to provide a plate producing apparatus having an improved plate producing ability, such that only a minimum wait time needs to be observed before a plate feeding can occur.

The present invention has the following features to attain the object above.

A first aspect of the present invention is directed to a plate producing apparatus for recording an image on plates retrieved from a plurality of cassettes based on image data transmitted from an image processing device, comprising: a cassette selection assembly for selecting one of the plurality of cassettes; a plate feeding assembly for retrieving a plate from the selected cassette; an image recording assembly for performing an image recording for the plate fed by the plate feeding assembly, based on the image data transmitted from the image processing device; and a control assembly for controlling the cassette selection assembly and the plate feeding assembly, wherein, at least before the image recording performed for the plate by the image recording assembly is completed, the control assembly obtains control information associated with a next plate and causes the cassette selection assembly to begin operating.

Thus, according to the first aspect, a cassette selection process for a next plate can be begun during an image recording for a current plate. Thus, a wait time to await the feeding of a plate in the image recording assembly can be reduced from that which is conventionally required, whereby the overall plate producing ability of the apparatus is enhanced.

According to a second aspect based on the first aspect, the control information is information which is supplied with respect to each plate from the image processing device to the control assembly.

Thus, according to the second aspect, control information is supplied with respect to each plate. This allows different attributes to be set for different plates.

According to a third aspect based on the second aspect, the plate feeding assembly feeds the plate to a neighborhood of the image recording assembly.

Thus, according to the third aspect, the distance between the plate feeding assembly and the image recording assembly can be minimized, so that the time required for loading a plate from the plate feeding assembly to the image recording assembly can also be minimized.

According to a fourth aspect based on the third aspect, the control assembly receives the control information associated with the next plate from the image processing device at least a predetermined time before a point of completion of the image recording for the plate, the predetermined time being equal to a sum of a time required for the cassette selection assembly to perform a cassette selection operation for the next plate and a time required for the plate feeding assembly to feed the next plate.

Thus, according to the fourth aspect, the plate has already been supplied to the neighborhood of the image recording assembly when the image recording for the previous plate is completed. Thus, the wait time in the image recording assembly can be further reduced.

According to a fifth aspect based on the fourth aspect, the control assembly determines whether or not to perform an exchange of cassettes based on the control information, and selectively causes the cassette selection assembly to begin operating based on a result of the determination.

Thus, according to the fifth aspect, the cassette selection assembly is operated only when an exchange of cassettes is necessary. As a result, unnecessary movements of cassettes are prevented, thereby reducing the occurrences of troubles in the cassette selection assembly.

According to a sixth aspect based on the fourth aspect, the image recording assembly comprises: an exposure section having a recording drum for irradiating the plate mounted on the recording drum with a light beam which is modulated in accordance with the image data transmitted from the image processing device; a plate loading section for mounting the plate fed from the plate feeding assembly on the recording drum; and a plate unloading section for releasing the plate from the recording drum after the image recording by the exposure section is performed for the plate.

According to a seventh aspect based on the first aspect, the control information is supplied from the image processing device to the control assembly with respect to each of a set of plates which are used to make one printed material, and, at least before the image recording performed for a non-last plate in the set by the image recording assembly is completed, the control assembly obtains control information associated with a next plate in the set and causes the cassette selection assembly to begin operating.

According to an eighth aspect based on the first aspect, the control information is supplied from the image processing device to the control assembly with respect to each of a set of plates which are used to make one printed material, and, at least before the image recording performed for a last plate in the set by the image recording assembly is completed, the control assembly obtains control information associated with a first plate in a next set and causes the cassette selection assembly to begin operating.

These and other objects, features, aspects and advantages of the present invention will become more apparent from the following detailed description of the present invention when taken in conjunction with the accompanying drawings.

DESCRIPTION OF THE PREFERRED EMBODIMENTS (first embodiment)

Figure 1:
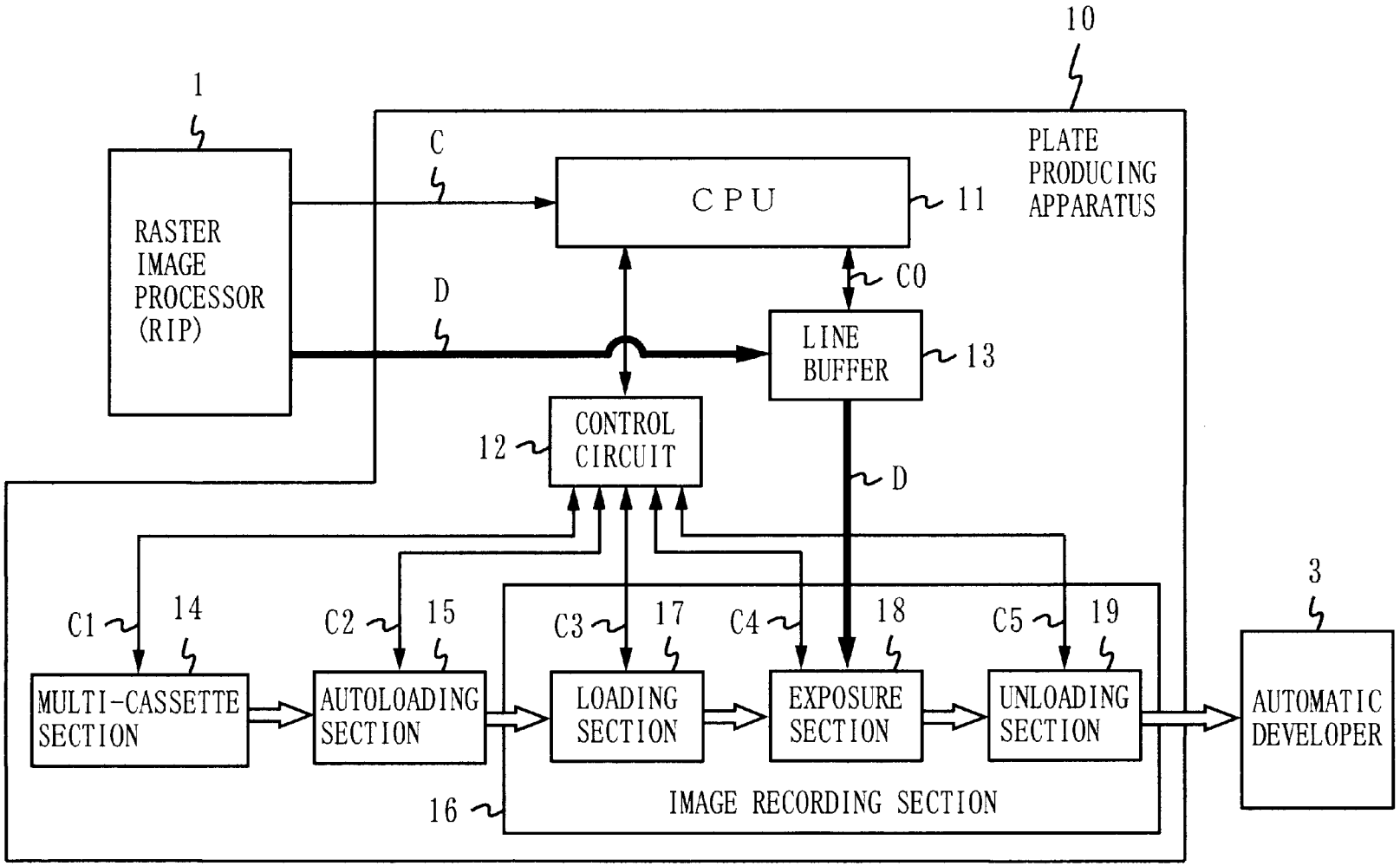
FIG. 1 is a block diagram illustrating the structure of a plate producing apparatus according to a first embodiment of the present invention.

FIG. 1 is a block diagram illustrating the structure of a plate producing apparatus 10 according to a first embodiment of the present invention. The plate producing apparatus 10 shown in FIG. 1 comprises: a CPU 11, a control circuit 12, a line buffer 13, a multi-cassette section 14, an autoloading section 15, and an image recording section 16. The image recording section 16 includes a loading section 17, an exposure section 18, and an unloading section 19. The plate producing apparatus 10 conveys a plate accommodated within a cassette 31 in the multi-cassette section 14 to the exposure section 18, and records an image on the conveyed plate at the exposure section 18. In FIG. 1, thin solid arrows indicate flows of control signals; thick solid arrows indicate flows of image data; and white arrows indicate the movement of a plate.

Figure 2:
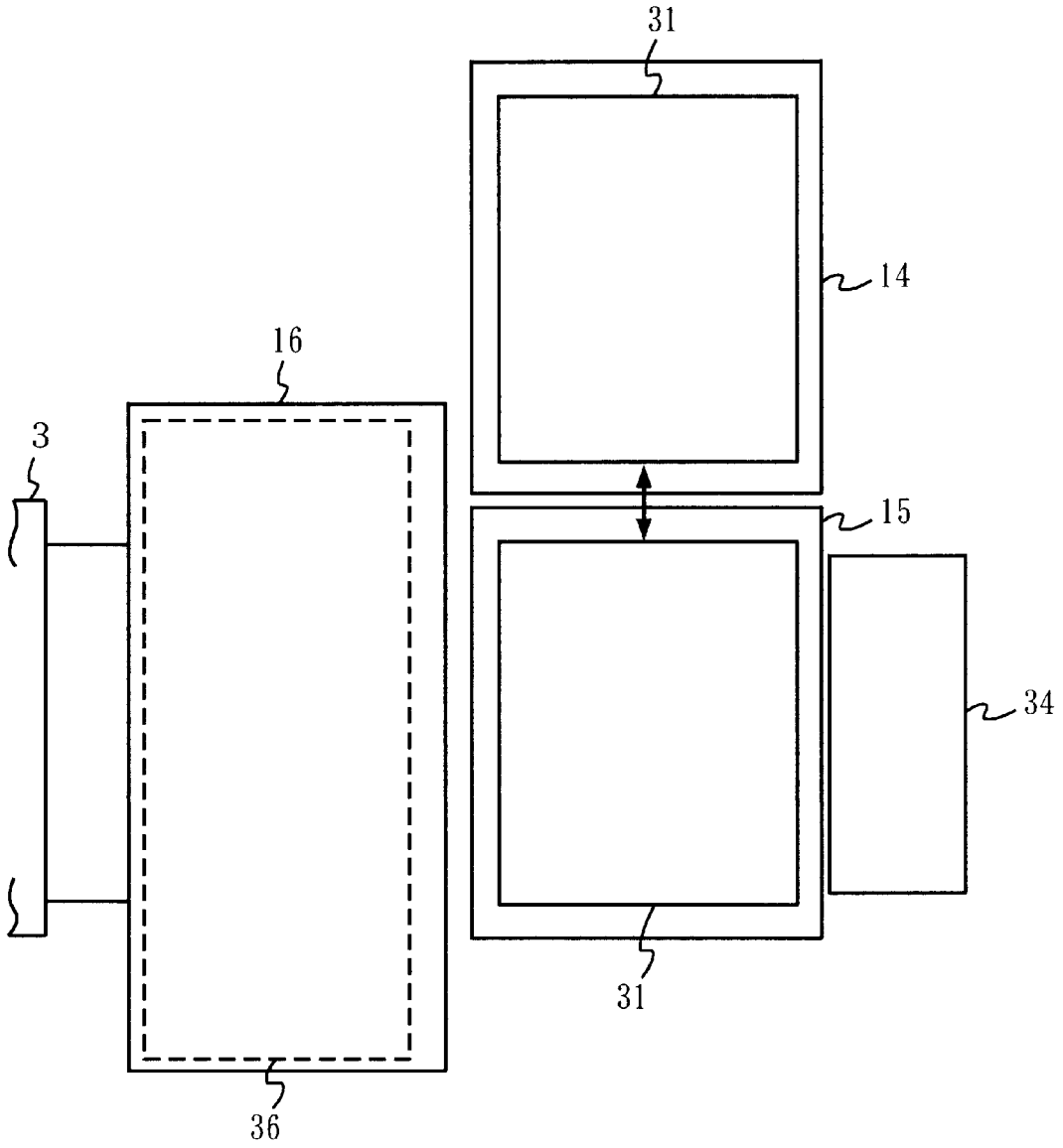
FIG. 2 is a plan view of the plate producing apparatus shown in FIG. 1.
Figure 3:
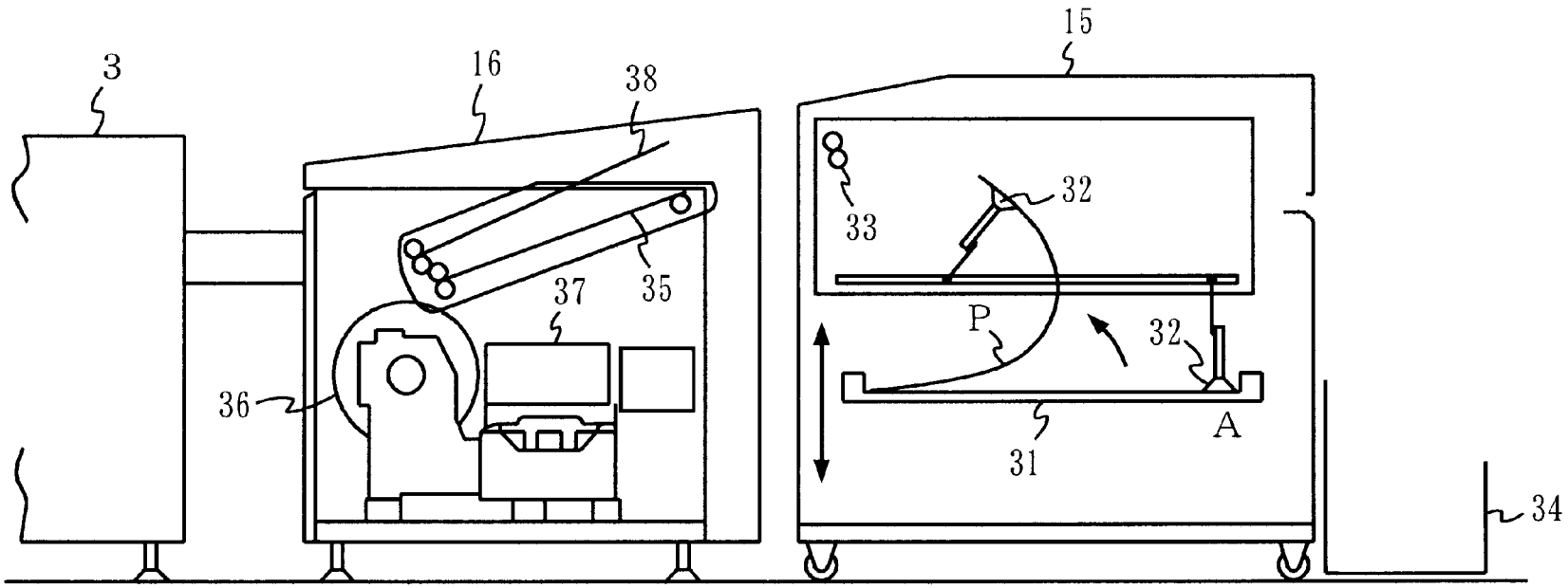
FIG. 3 is a front view of the plate producing apparatus shown in FIG. 1.
Figure 4:
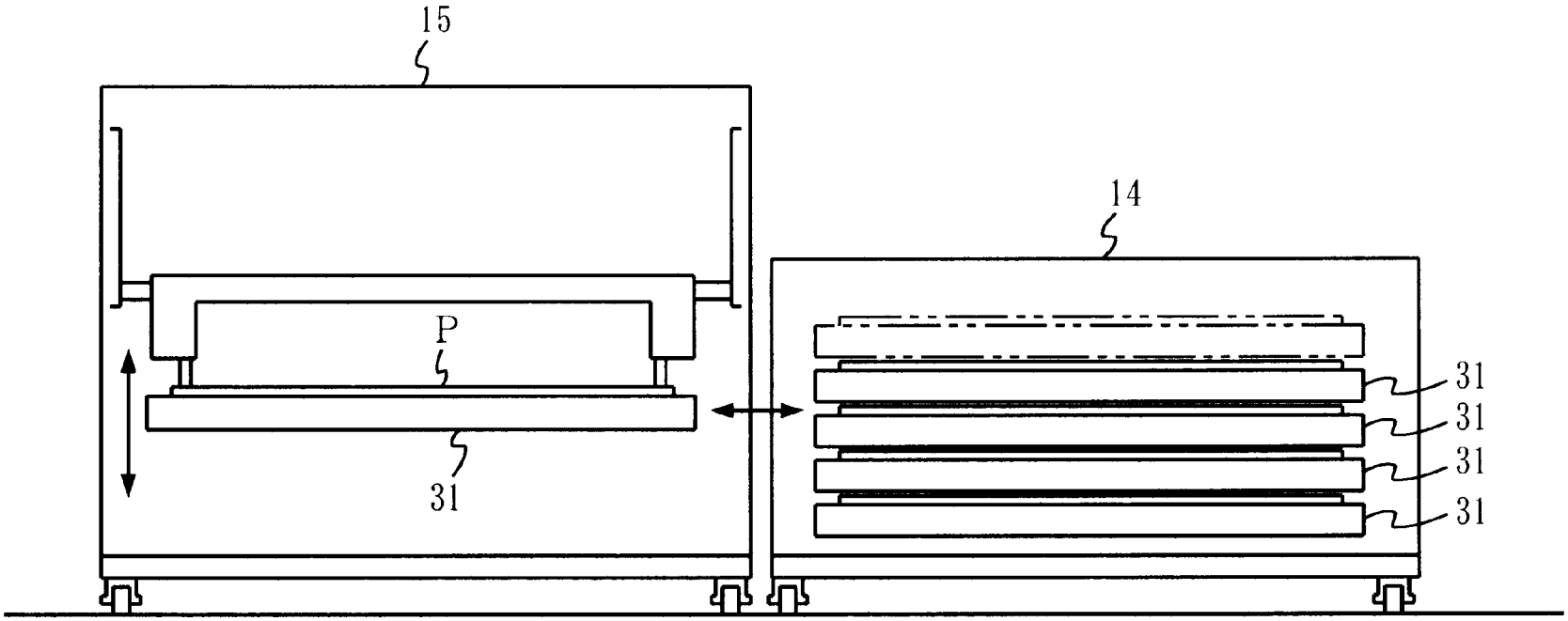
FIG. 4 is a side view of the plate producing apparatus shown in FIG. 1.

FIGS. 2, 3, and 4 are a plan view, a front view, and a side view, respectively, of the plate producing apparatus 10. As shown in FIG. 4, the multi-cassette section 14 includes a plurality of cassettes 31 which are layered along the vertical direction. Each cassette 31 accommodates a different type of plates P. When feeding a plate P accommodated in one of the cassettes 31 to the image recording section 16, the cassette 31 is horizontally moved from the multi-cassette section 14 to the autoloading section 15, as shown in FIG. 4.

The autoloading section 15 moves up and down the cassette 31, which has undergone the horizontal movement, to a predetermined position (hereinafter referred to as a "plate feeding position"). As shown in FIG. 3, the autoloading section 15 includes a suction pad 32 which suck on the plate P, and a pair of rollers 33 for conveying the plate P to the image recording section 16. The suction pad 32 sucks on a farther end of the plate P in the cassette 31, i.e., the end which is away from the image recording section 16 (shown at "A" in FIG. 3). Next, the suction pad 32 moves through the space in a circular trajectory until the sucked end of the plate P reaches the rollers 33. Once the sucked end of the plate P reaches the rollers 33, the suction pad 32 terminates suction and releases the plate P. Via this action of the suction pad 32, the autoloading section 15 retrieves a plate P (one at a time) from the cassette 31 which has been moved to the plate feeding position, and feeds the plate P to the image recording section 16.

The plate P which has been fed to the image recording section 16 is conveyed along a feed path 35 in the image recording section 16, and comes to a halt at a position (hereinafter referred to as a "pre-loading position") just short of going onto a recording drum 36. After feeding the plate P to the image recording section 16, the autoloading section 15 ejects the slip sheets which are inserted between the plates into a slip sheet bin 34, by means of a slip sheet elimination mechanism (not shown). Hereinafter, the process of retrieving a plate P from the cassette 31 and conveying the plate P to the pre-loading position and the process of ejecting the slip sheet will be collectively referred to as a "loading preparation process".

As mentioned above, the image recording section 16 includes the loading section 17, the exposure section 18, and the unloading section 19. The exposure section 18, which includes the aforementioned recording drum 36 and recording head 37, receives image data D from the RIP 1 via the line buffer 13. The recording drum 36 has a cylindrical outer surface, on which a plate P is to be wound. The recording head 37 irradiates a plate mounted on the recording drum 36 with a light beam which has been modulated in accordance with the image data D. As a result, the image recording section 16 records an image received from the RIP 1 on the plate P mounted on the recording drum 36.

The loading section 17 functions to wind the plate P which is halted in the pre-loading position on the feed path 35 around the recording drum 36 (hereinafter this process will be referred to as a "loading process"). The unloading section 19 functions to remove the recorded plate P from the recording drum 36, and move the plate P in an i-turn fashion along an ejection path 38 so as to be ejected to the outside (hereinafter this process will be referred to as an "unloading process"). For example, an automatic developer 3 may be provided downstream of the plate producing apparatus 10. The automatic developer 3 may subject the recorded plate P to a development process with a processing agent and thereafter dry the plate P.

Thus, the plate producing apparatus 10 moves one of the plurality of cassettes 31 accommodating plates P through a horizontally movement and then through up-and-down movements to a plate feeding position, and then retrieves a plate P from the cassette 31 having thus been moved. Furthermore, in the image recording section 16, loading, exposure, and unloading processes are sequentially performed for the retrieved plate P.

Referring back to FIG. 1, a control system of the plate producing apparatus 10 will be described. The CPU 11 shown in FIG. 1 controls the overall operation of the plate producing apparatus 10. The control circuit 12 reciprocally converts input/output signals of the CPU 11 and control signals for the respective sections.

An image to be recorded on a plate is supplied from the RIP 1. For each plate, the RIP 1 supplies control information C representing the size and thickness of that plate as well as image data D for that plate to the plate producing apparatus 10. Based on the control information C received from the RIP 1, the CPU 11 outputs control signals C0 to C5 with appropriate timing. In this manner, the CPU 11 controls the line buffer 13, the multi-cassette section 14, the autoloading section 15, the loading section 17, the exposure section 18, and the unloading section 19.

In accordance with the control signal C1, the multi-cassette section 14 selects one of the cassettes 31, and horizontally moves the selected cassette to the autoloading section 15. Through up-and-down movements, the autoloading section 15 brings the cassette 31 which has undergone the horizontal movement to the plate feeding position, and performs a loading preparation process in accordance with the control signal C2. The loading section 17 and the unloading section 19 perform a loading process and an unloading process, respectively, in accordance with the control signals C3 and C5, respectively.

In the exposure section 18, the recording drum 36 is rotated in accordance with the control signal C4. The recording head 37 irradiates the plate mounted on the recording drum 36 with a light beam which has been modulated in accordance with the image data D. Note that the image data D is bit map information obtained by separating a color image to be recorded on a plate into respective chromatic components and expressing one of the resultant single-color images in a bitmap format. The image data D is supplied from the RIP 1 to the exposure section 18, via the line buffer 13.

The line buffer 13 includes two buffers, each of which is capable of storing one line of data for use by the recording head 37. In accordance with the control signal C0, the line buffer 13 receives line-by-line image data D from the RIP 1 into one of its buffers, and concurrently supplies from the other buffer the previously-received image data D to the exposure section 18. When the recording head 37 has recorded one line of image data D on the plate, the line buffer 13 switches the roles of the two buffers. Thus, the line buffer 13 is capable of supplying image data D to the exposure section 18 while receiving image data D from the RIP 1.

According to the present invention, parallel operations of the component elements of the plate producing apparatus 10 are realized by taking the following aspects into account. Firstly, in the image recording section 16, the recording drum 36 is occupied while either the loading section 17, the exposure section 18, or the unloading section 19 is in operation. This means that the three processes in the image recording section 16, i.e., loading, exposure, and unloading, cannot be executed in a parallel manner. Secondly, once the loading process is completed, the plate P is no longer present on the feed path 35. That is, the autoloading section 15 is ready to begin a loading preparation process at any point thereafter. Thirdly, when the type of plate is changed, it is necessary to exchange cassettes 31 accommodating plates P prior to the loading preparation process.

Figure 5:
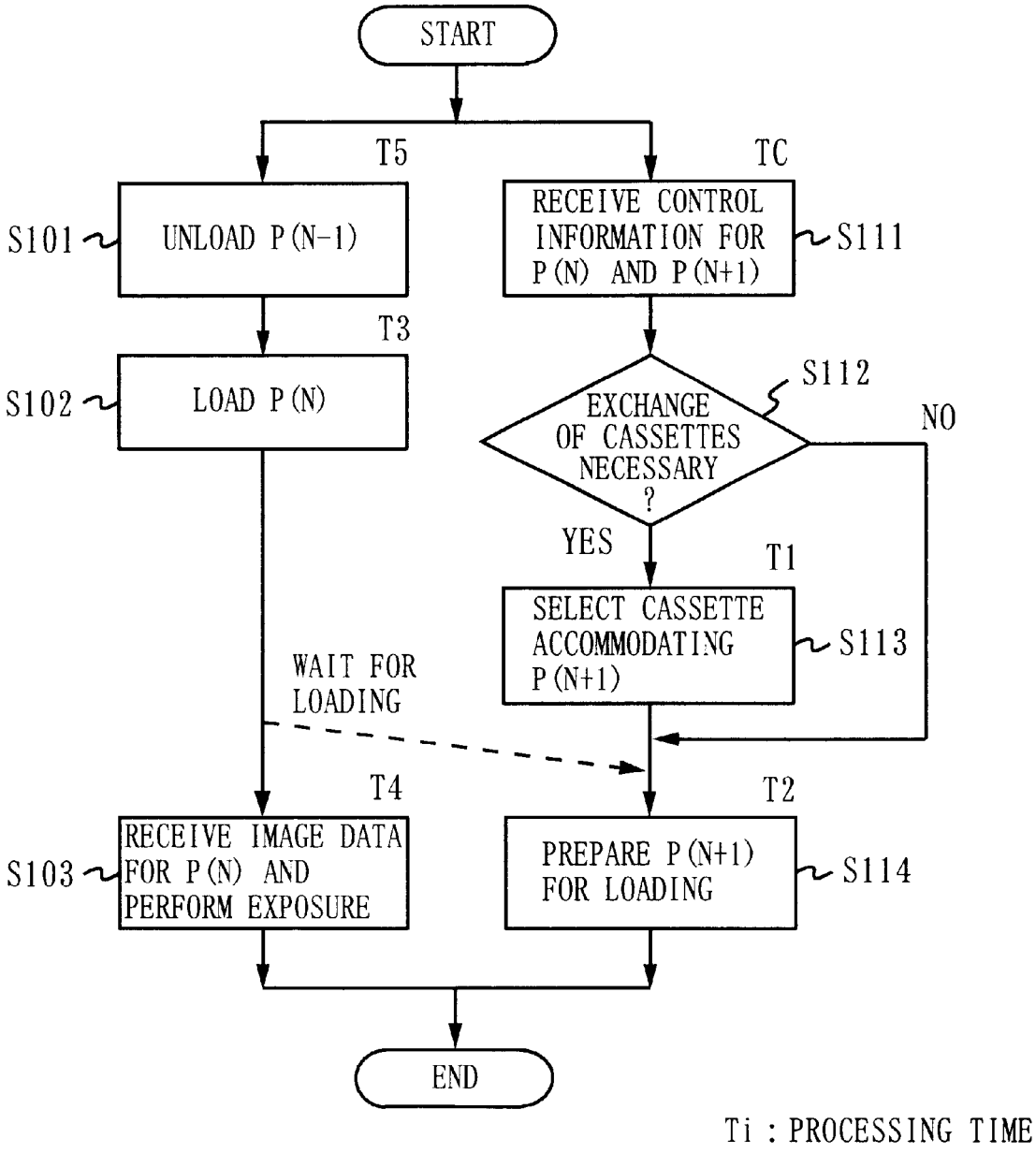
FIG. 5 is a flowchart illustrating the operation of the plate producing apparatus shown in FIG. 1.

FIG. 5 is a flowchart illustrating the operation of the plate producing apparatus 10 according to the present invention, which has been conceived by taking into account the aforementioned aspects. Hereinafter, an $i^{th}$ plate will be denoted as P(i). The processing times required by the CPU 11, the multi-cassette section 14, the autoloading section 15, the loading section 17, the exposure section 18, and the unloading section 19 to process one plate will be denoted as $T_C$, $T_1$, $T_2$, $T_3$, $T_4$, and $T_5$, respectively. Note that, in most cases, the exposure time $T_4$ is the longest among other processing times required in the plate producing apparatus 10.

With reference to FIG. 5, the operation of the plate producing apparatus 10 after an image has been recorded on a plate P(N−1) will be described. As shown in FIG. 5, the plate producing apparatus 10 executes the processes from steps S101 to S103 and the processes from steps S111 to S114 in a parallel manner. It is assumed that a plate P(N) is halted at the pre-loading position on the feed path 35 in an initial state.

Once the image recording for the plate P(N−1) is completed, the CPU 11 outputs the control signal C5 to instruct the unloading section 19 to begin an unloading process (step S101). As a result, the plate P(N−1) is released from the recording drum 36, and ejected to the outside of the plate producing apparatus 10. Once the unloading process is completed, the CPU 11 outputs the control signal C3 to instruct the loading section 17 to begin a loading process (step S102). As a result, the plate P(N) which is halted at the pre-loading position on the feed path 35 is wound around the recording drum 36.

Once the loading process is completed, the CPU 11 outputs the control signal C4 to instruct the exposure section 18 to begin an exposure process (step S103). As a result, the exposure section 18 reads image data D for the plate P(N) from the line buffer 13, and irradiates the plate P(N) currently mounted on the recording drum 36 with a laser light beam which has been modulated in accordance with the image data D read. Thus, desired image data is recorded on the plate P(N).

Concurrently with the instruction to begin the process of unloading the plate (N−1), the CPU 11 receives control information C associated with the plate P(N) and a plate P(N+1) from the RIP 1 (step S111). Next, the CPU 11 compares the control information associated with the plate P(N) and the control information associated with the plate (N+1) to determine whether or not an exchange of cassettes is necessary in order to feed the plate P(N+1) (step S112). If an exchange of cassettes is necessary (following the YES path from step S112), the CPU 11 outputs a control signal C1 which points to the cassette 31 accommodating the plate P(N+1), and instructs the multi-cassette section 14 to perform a cassette selection process (step S113). As a result, the cassette 31 accommodating the plate P(N+1) is horizontally moved from the multi-cassette section 14 to the autoloading section 15. The autoloading section 15 moves the cassette 31 after undergoing the horizontal movement to the plate feeding position through up-and-down movements.

Next, after the completion of the loading process (step S102) and the optionally-performed cassette selection process (step S113), the CPU 11 outputs the control signal C2 to instruct the autoloading section 15 to begin a loading preparation process (step S114). The dotted arrow shown in FIG. 5 signifies that the process of step S114 is performed after the completion of the process of step S102. At step S114, the autoloading section 15 retrieves the plate P from the cassette 31 which is currently located at the plate feeding position, and feeds the plate to the image recording section 16. Thus, it will be understood that the plate P(N+1) is halted at the pre-loading position on the feed path 35 when step S114 has just been completed. Thus, by performing a loading preparation process after an optional exchange of cassettes, a cassette 31 accommodating the next plate P can be selected from among the plurality of cassettes 31, and the next plate P can be properly fed from that cassette to the image recording section 16.

Figure 6:
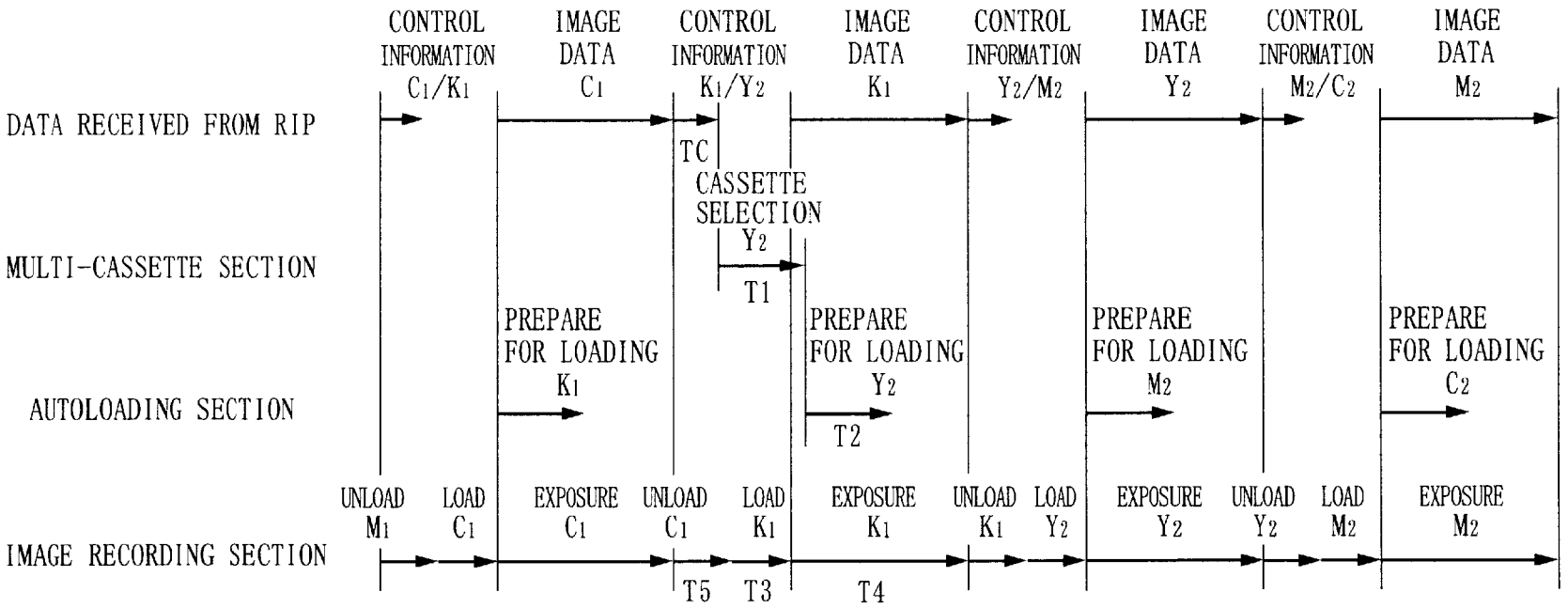
FIG. 6 is a timing diagram illustrating the operation of the plate producing apparatus shown in FIG. 1.

FIG. 6 is a timing diagram illustrating the operation of the plate producing apparatus 10. FIG. 6 illustrates a manner in which the last two plates $C_1$ and $K_1$ among a first set of plates $Y_1$, $M_1$, $C_1$, and $K_1$ are sequentially processed in the image recording section 16 and thereafter the first two plates $Y_2$ and $M_2$ among a second set of plates $Y_2$, $M_2$, $C_2$, and $K_2$ are sequentially processed (plates $Y_1$ and $K_2$ are not illustrated). It is assumed that the first set of plates and the second set of plates are of different types, so that an exchange of cassettes is necessary.

According to the present embodiment, given the amount of time $T_1$ required for selecting a cassette and the amount of time $T_2$ required for retrieving a plate from a cassette and conveying the plate to the pre-loading position, it is ensured that the control information associated with any given plate is supplied at a point which is at least $(T_1+T_2)$ before the point of completion of the image recording for a previous plate. Thus, even when an exchange of cassettes needs to be performed, a plate can be loaded onto the recording drum without delay after completion of the image recording for the previous plate. It can be seen from FIG. 6 that the control information $Y_2$ associated with the plate $Y_2$, which follows the plate $K_1$, is supplied even earlier than $(T_1+T_2)$ before the exposure for the previous plate $K_1$ is completed. As a result, before the completion of the exposure for the plate $K_1$, it is possible to perform an exchange of cassettes, retrieve a plate (i.e., the next plate $Y_2$) from the cassette, and convey the plate $Y_2$ to the pre-loading position in a timely manner.

In the case where the timing of supplying the control information associated with a next plate is prescribed as above, the only processes which need to be performed after the exposure for the previous plate and before beginning the exposure for the next plate are the inevitable processes, i.e., the unloading of the previous plate and the loading of the next plate. Thus, the operation efficiency of the image recording section 16 can be maximized.

Even if the travel of the next plate $Y_2$ to the preloading position is not completed before the completion of the image recording for the previous plate $K_1$, the working efficiency of the image recording apparatus can still be improved compared to the conventional level so long as the cassette selection for the plate $Y_2$ is begun before the completion of the image recording for the plate $K_1$.

Figure 7:
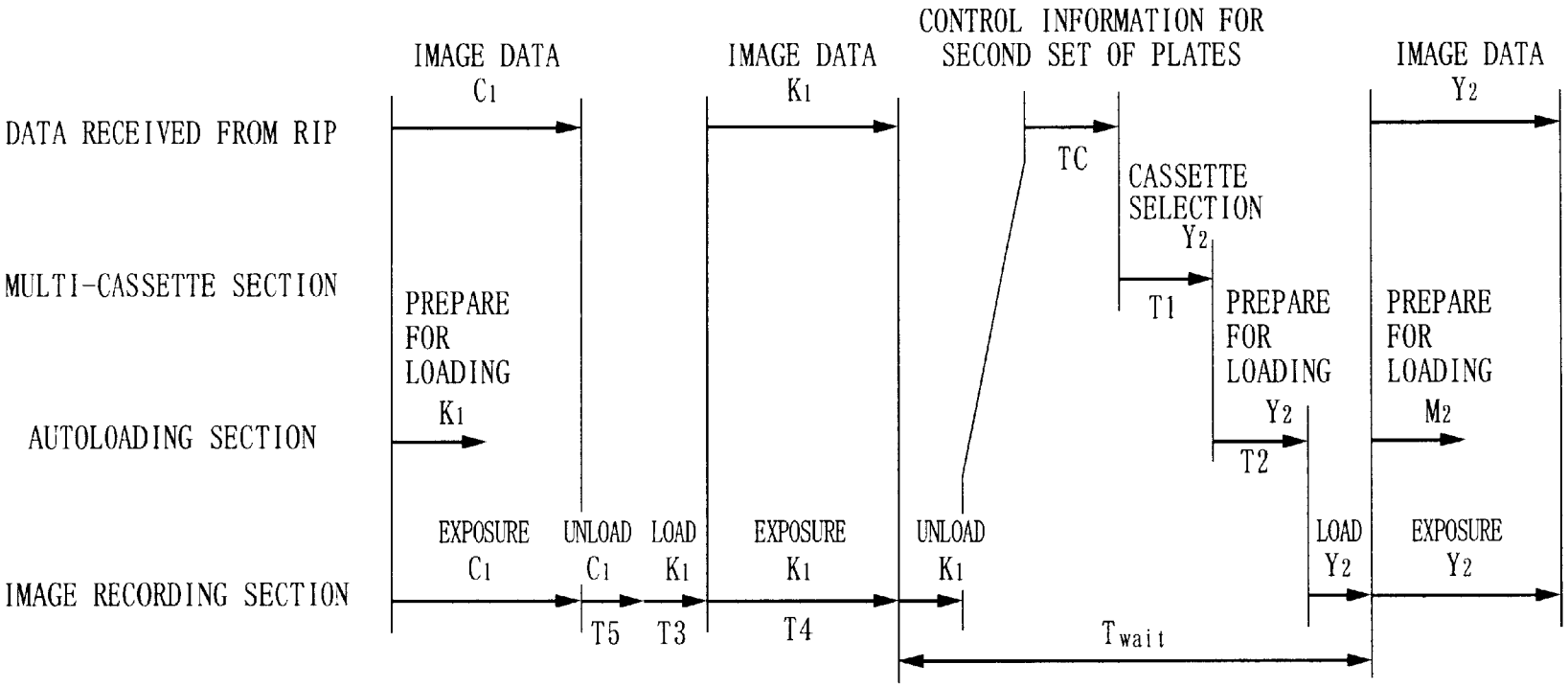
FIG. 7 PRIOR ART
FIG. 7 is a timing diagram illustrating the operation of a conventional plate producing apparatus.

FIG. 7 is a timing diagram illustrating the operation of a conventional plate producing apparatus. In this conventional example, the control information associated with a second set of plates is supplied only after the exposure for the last plate $K_1$ among the first set of plates is completed. Therefore, the proper cassette for the next set of plates cannot be determined until the exposure for the last plate $K_1$ among the first set of plates is completed. Hence, as shown in FIG. 7, a wait time $T_{wait}$ must be observed after the completion of the exposure for the plate $K_1$ and before the completion of the feeding of the next plate (i.e., the first plate $Y_2$ among the second set of plates), thus making it impossible to exploiting the image recording section to its full capacity. As will be clear from FIGS. 6 and 7, the plate producing apparatus according to the present embodiment of the invention can produce plates faster than the conventional plate producing apparatus, because there is no need to observe a wait time $T_{wait}$ to await the feeding of a second set of plates in the image recording section after the completion of the exposure for the first set of plates.

The present embodiment illustrates a case where control information associated with two plates is received before recording of an image on a plate is performed; alternatively, only the control information associated with the next plate may be received and stored within the plate producing apparatus. The present embodiment illustrates a case where the control information associated with each plate is received together with the image data for one plate before the current plate; alternatively, the control information may be received at an earlier point, e.g., together with the image data for two plates before the current plate; further alternatively, control information associated with more than one plate may be concurrently received. In either case, the same effects as those under the present embodiment are obtained because a cassette selection process and a loading preparation process for a next plate can be performed while performing a recording an image on a current plate.

(second embodiment)

Figure 8:
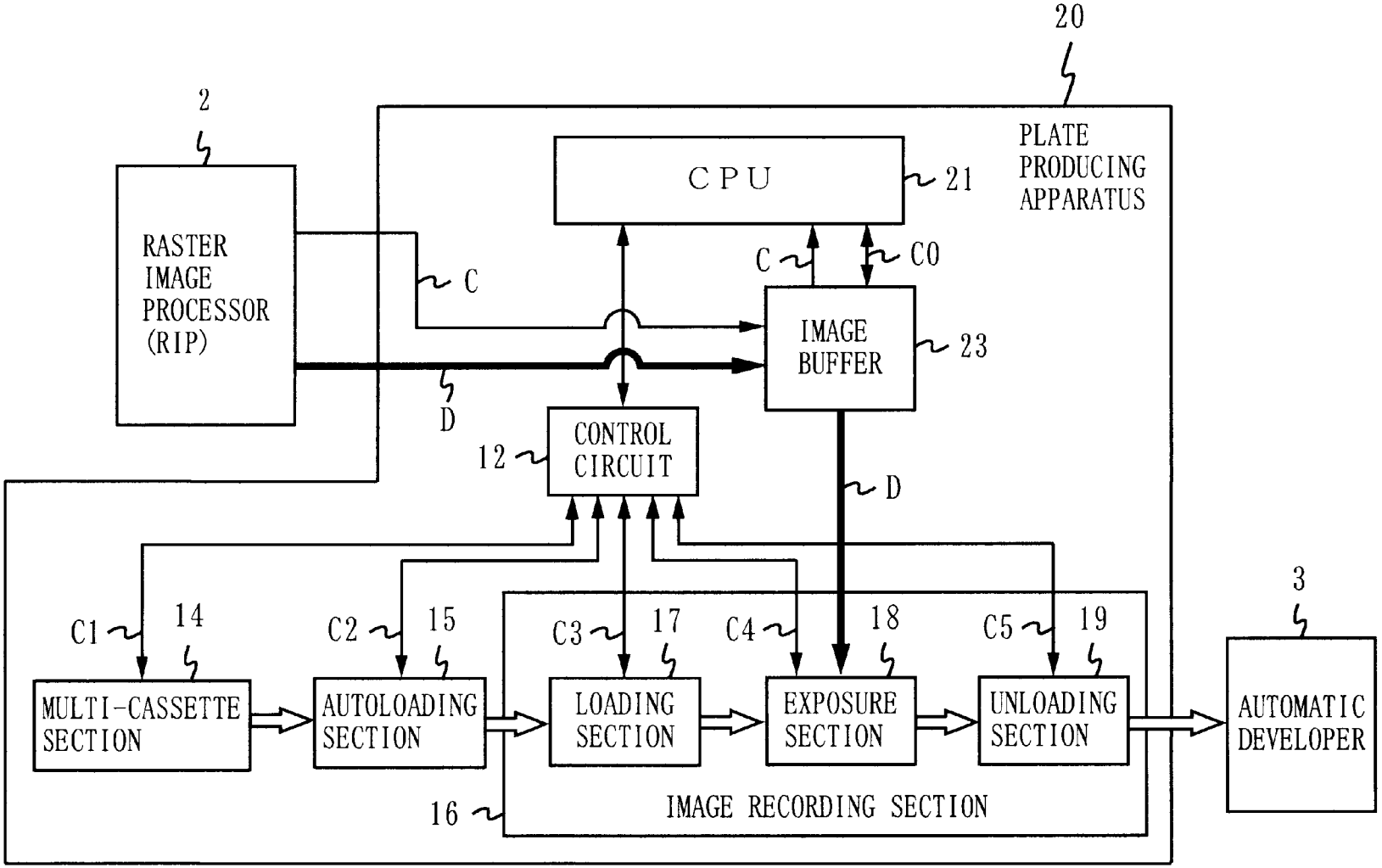
FIG. 8 is a block diagram illustrating the structure of a plate producing apparatus according to a second embodiment of the present invention.

FIG. 8 is a block diagram illustrating the structure of a plate producing apparatus 20 according to a second embodiment of the present invention. The plate producing apparatus 20 shown in FIG. 8 differs from the plate producing apparatus 10 according to the first embodiment in that the plate producing apparatus 20 comprises an image buffer 23 and that the CPU 21 performs different processing. Any component elements of the plate producing apparatus 20 of the present embodiment which also appeared in the first embodiment are denoted by the same reference numerals as those used therein, and the description thereof will be omitted.

As in the first embodiment, the RIP 2 supplies control information C and image data D associated with each plate to the plate producing apparatus 20. As in the first embodiment, the CPU 21 outputs control signals C0 to C5 based on the received control information C to control the multi-cassette section 14 and other component elements.

The image buffer 23 includes two buffers, each of which is capable of storing a unit of data corresponding to one plate. These two buffers are utilized in such a manner that, while receiving the control information C and image data D from the RIP 2, the image buffer 23 supplies the control information C and the image data D to the CPU 21 and the exposure section 18, respectively, as in the manner of the first embodiment. However, according to the present embodiment, the image data D is transmitted from the RIP 2 in units corresponding to one plate, and supplied to the exposure section 18 in units corresponding to one plate.

Figure 9:
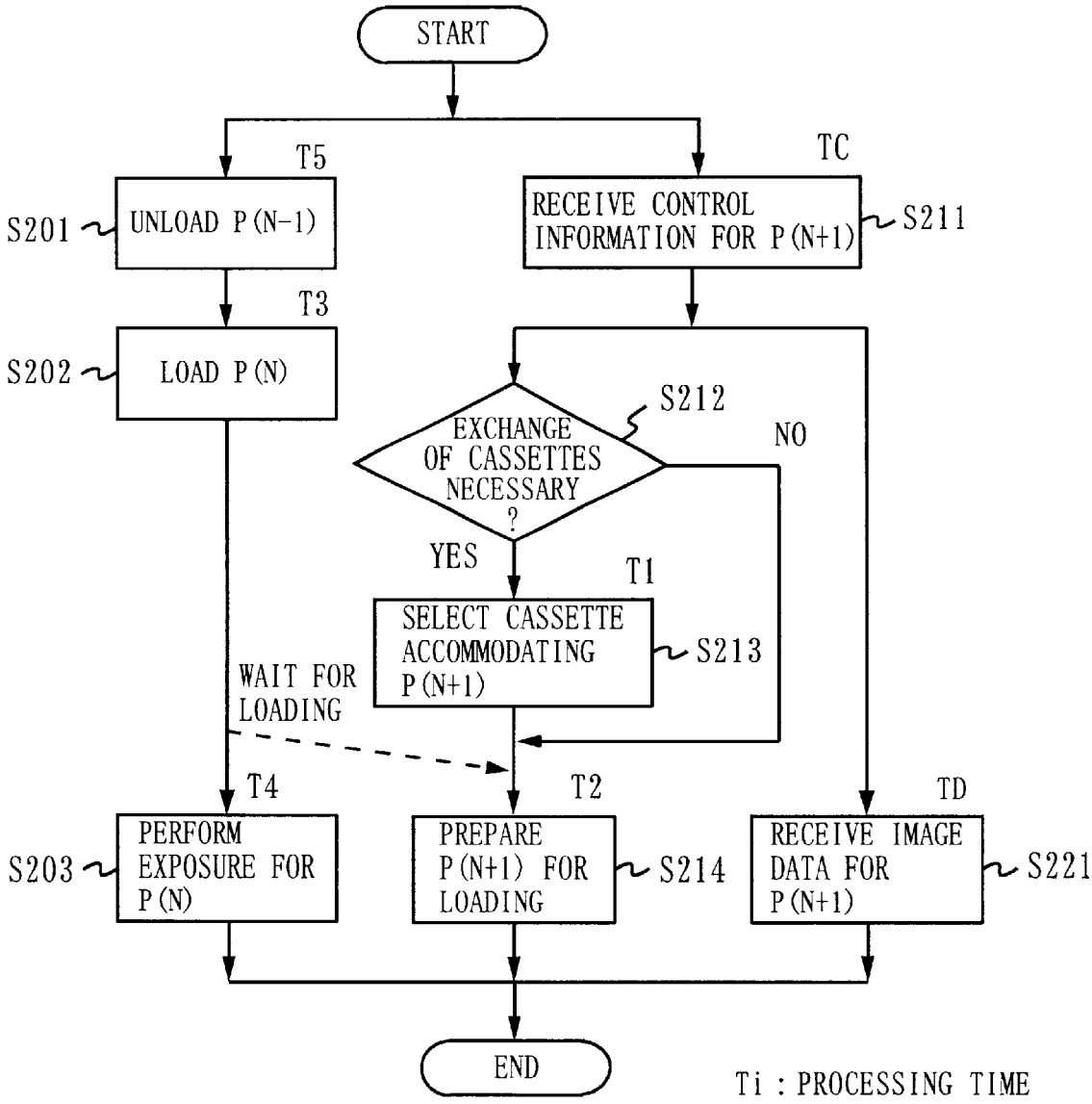
FIG. 9 is a flowchart illustrating the operation of the plate producing apparatus shown in FIG. 8.

FIG. 9 is a flowchart illustrating the operation of the plate producing apparatus 20. Referring to FIG. 9, an operation of the plate producing apparatus 20 after completing an image recording on a plate P(N−1) will be described. As shown in FIG. 9, the plate producing apparatus 20 executes the processes from steps S201 to S203 and the processes from steps S211 to S214 in a parallel manner. Moreover, the plate producing apparatus 20 executes the processes from steps S212 to S214 and the process of step S221 in a parallel manner. It is assumed that, in an initial state, a plate P(N) is halted at the pre-loading position on a feed path 35 and the image data for the plate P(N) is stored in one of the buffers in the image buffer 23.

Once the image recording for the plate P(N−1) is completed, the CPU 21 instructs an unloading process to be begun (step S201), and then instructs a loading process for the plate P(N) to be begun (step S202), as in the first embodiment. As a result, the plate P(N−1) is released from the recording drum 36, and ejected to the outside of the plate producing apparatus 20, and the plate P(N) which is halted at the pre-loading position on the feed path 35 is wound around the recording drum 36.

Once the loading process is completed, the CPU 21 outputs the control signal C4 to instruct the exposure section 18 to begin an exposure process (step S203). At this point, image data for the plate P(N) is stored in the one of the buffers in the image buffer 23. The exposure section 18 reads the image data D from this buffer, and irradiates the plate P(N) currently mounted on the recording drum 36 with a laser light beam which has been modulated in accordance with the image data Dread. Thus, desired image data is recorded on the plate P(N)

Concurrently with the instruction to begin an unloading process, the CPU 21 outputs the control signal C0, and instructs the image buffer 23 to receive the control information C (step S211). Thus, the image buffer 23 receives the control information C associated with the plate P(N+1) from the RIP 2. Next, the CPU 21 compares the control information associated with the plate P(N) and the control information associated with the plate P(N+1) stored in the image buffer 23 to determine whether or not an exchange of cassettes is necessary (step S212). Next, as in the first embodiment, the CPU 11 instructs a cassette selection process to be performed as necessary (step S213). After the completion of the loading process (step S202) and the optionally-performed cassette selection process (step S213), the CPU 21 instructs a loading preparation process to be begun (step S214). Thus, it will be understood that the plate P(N+1) is halted at the pre-loading position on the feed path 35 when step S214 has just been completed.

Furthermore, after the image buffer 23 completes the reception of the control information C associated with the plate P(N+1)(step S211), the CPU 21 again outputs the control signal C0 to instruct the image buffer 23 to receive the image data D (step S221) with a processing time of $T_D$. As a result, the image buffer 23 receives the image data D for the plate P(N+1) from the RIP 2, and stores the received image data D in one of the buffers not used for storing the image data for the plate P(N).

Figure 10:
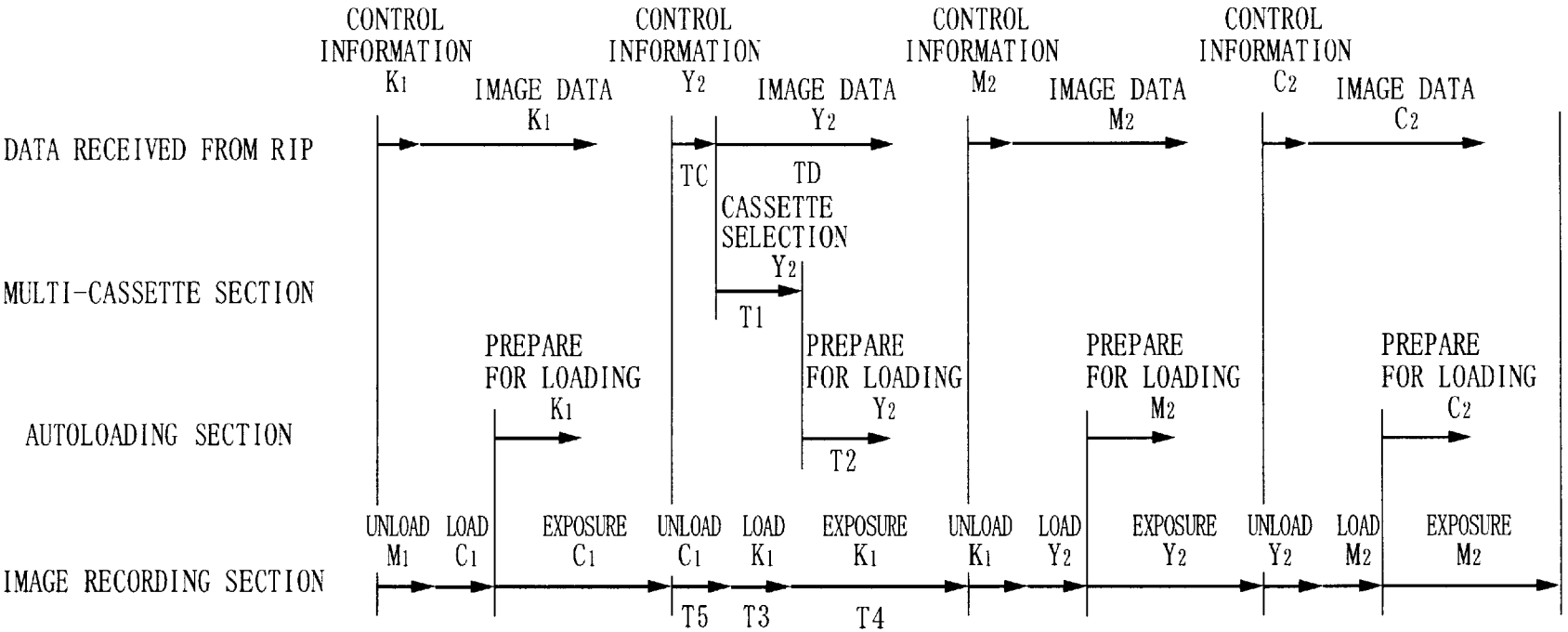
FIG. 10 is a timing diagram illustrating the operation of the plate producing apparatus shown in FIG. 8.

FIG. 10 is a timing diagram illustrating the operation of the plate producing apparatus 20. FIG. 10 illustrates a manner in which the last two plates $C_1$ and $K_1$ among a first set of plates $Y_1$, $M_1$, $C_1$, and $K_1$ are sequentially processed in the image recording section 16 and thereafter the first two plates $Y_2$ and $M_2$ among a second set of plates $Y_2$, $M_2$, $C_2$, and $K_2$ are sequentially processed. It is assumed that the first set of plates and the second set of plates are of different types, so that an exchange of cassettes is necessary.

Unlike the first embodiment, the second embodiment ensures that image data is stored in the image buffer 23 before beginning an image recording. Therefore, in order to transmit the control information associated with each plate before transmitting the image data, the transmission timing of the control information must be determined by taking into account the amount of time required for transmitting the image data.

Moreover, given the amount of time $T_1$ required for selecting a cassette and the amount of time $T_2$ required for retrieving a plate from a cassette and conveying the plate to the pre-loading position, it is ensured that the control information associated with any given plate is supplied at a point which is at least $(T_1+T_2)$ before the point of completion of the image recording for a previous plate. Thus, even when an exchange of cassettes needs to be performed, a plate can be loaded onto the recording drum without delay after completion of the image recording for the previous plate. It can be seen from FIG. 10 that the control information $Y_2$ associated with the plate $Y_2$, which follows the plate $K_1$, is supplied even earlier than $(T_1+T_2)$ before the exposure for the previous plate $K_1$ is completed. As a result, before the completion of the exposure for the plate $K_1$, it is possible to perform an exchange of cassettes, retrieve a plate (i.e., the next plate $Y_2$) from the cassette, and convey the plate $Y_2$ to the pre-loading position in a timely manner.

In the case where the timing of supplying the control information associated with a next plate is prescribed as above, the only processes which need to be performed after the exposure for the previous plate and before beginning the exposure for the next plate are the inevitable processes, i.e., the unloading of the previous plate and the loading of the next plate. Thus, the operation efficiency of the image recording section 16 can be maximized.

Even if the travel of the next plate $Y_2$ to the preloading position is not completed before the completion of the image recording for the previous plate $K_1$, the working efficiency of the image recording apparatus can still be improved compared to the conventional level so long as the cassette selection for the plate $Y_2$ is begun before the completion of the image recording for the plate $K_1$.

As described above, in accordance with the plate producing apparatus of the present embodiment, the control information associated with a next plate is received at an earlier point in time, so that a cassette selection process and a loading preparation process can thereafter be performed based on the received control information associated with the next plate. Thus, as in the first embodiment, the wait time to await the feeding of a plate in the image recording section can be reduced, whereby an improved plate producing ability is provided.

The first and second embodiments illustrate the case where a set of plates used for making one printed material only comprise the same type of plates, so that the set of plates can be supplied from the same cassette. However, the present invention is not limited thereto; alternatively, members of a set of plates used for making one printed material may be supplied from different cassettes. In this case, at least before the image recording performed for a non-last plate in a given set of plates is completed, the CPU 11 may obtain control information associated with a next plate in the set and cause the multi-cassette section 14 to begin operating, and, at least before the image recording performed for the last plate in the set is completed, the CPU 11 may obtain control information associated with a first plate in a next set and cause the multi-cassette section 14 to begin operating. As a result, similar effects to those according to the first and second embodiments can be obtained.

While the invention has been described in detail, the foregoing description is in all aspects illustrative and not restrictive. It is understood that numerous other modifications and variations can be devised without departing from the scope of the invention.

What is claimed is:

1. A plate producing apparatus, comprising:

an image processing assembly for transmitting image data associated with a plurality of color separation images, which are used for making a printed material, and control information created for each of a plurality of plates required for recording the plurality of color separation images;

a plurality of cassettes for accommodating plates;

a cassette selection assembly for selecting a cassette from the plurality of cassettes and moving the selected cassette to a plate feeding position;

a plate retrieving assembly for retrieving a plate from the cassette located in the plate feeding position;

a feed path for moving the plate retrieved by the plate retrieving assembly to a pre-loading position just short of going onto a next stage;

a recording drum for mounting the plate thereon;

a recording head for irradiating the plate mounted on the recording drum with a laser beam which is modulated in accordance with the image data transmitted from the image processing assembly; and a control assembly for receiving the control information from the image processing assembly after the start of an image recording for a plate on which a first one of the plurality of color separation images is recorded, the control information being associated with a prescribed one of the plurality of color separation images, which is different from said first one of the plurality of color separation images, the control assembly determining whether a cassette movement by the cassette selection assembly is required based on the control information, wherein if it is determined that the cassette movement by the cassette selection assembly is required, the control assembly controls the cassette selection assembly such that a cassette having accommodated therein a plate, which is used for recording said prescribed one of the plurality of color separation images, starts moving toward the plate feeding position before the completion of the image recording for a plate on which a color separation image immediately before said prescribed one of the plurality of color separation images is recorded.

2. The plate producing apparatus according to claim 1, wherein before the completion of the image recording for a plate on which a last one of a plurality of color separation images forming a printed material is recorded, the control assembly receives from the image processing assembly the control information associated with a first one of a plurality of color separation images forming a different printed material, and determines based on the control information whether the cassette movement by the cassette selection assembly is required, and wherein if it is determined that the cassette movement by the cassette selection assembly is required, the control assembly controls the cassette selection assembly such that a cassette having accommodated therein a plate, which is used for recording said first one of the plurality of color separation images forming the different printed material, starts moving toward the plate feeding position before the completion of the image recording for a plate on which said last one of the plurality of color separation images is recorded.

3. The plate producing apparatus according to claim 2, wherein if it is determined that the cassette movement by the cassette selection assembly is required, the control assembly controls the cassette selection assembly such that the cassette having accommodated therein the plate, which is used for recording said first one of the plurality of color separation images forming the different printed material, reaches the plate feeding position before the completion of the image recording for the plate on which said last one of the plurality of color separation images is recorded.

4. The plate producing apparatus according to claim 3, wherein the plurality of cassettes are layered along the vertical direction within a multi-cassette section;

the cassette selection assembly functions as an autoloading section for horizontally moving a cassette selected from the multi-cassette section and moving up or down the cassette, which has undergone a horizontal movement, to the plate feeding position, wherein the plate retrieving assembly has a suction pad for sucking on an end of a plate accommodated in the cassette located in the plate feeding position and moving in a circular trajectory, thereby retrieving the plate, and wherein the plate is mounted on the recording drum such that a surface of the plate opposite to the surface sucked by the suction pad is irradiated with the laser beam from the recording head.

* * * * *